US009732767B2

(12) United States Patent
Cooley et al.

(10) Patent No.: US 9,732,767 B2
(45) Date of Patent: Aug. 15, 2017

(54) COMPRESSOR COVER WITH INTEGRATED HEAT SHIELD FOR AN ACTUATOR

(71) Applicant: BorgWarner Inc., Auburn Hills, MI (US)

(72) Inventors: Matthew Cooley, Asheville, NC (US); Aaron Date, Asheville, NC (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 14/854,619

(22) Filed: Sep. 15, 2015

(65) Prior Publication Data

US 2016/0186779 A1 Jun. 30, 2016

Related U.S. Application Data

(63) Continuation of application No. 14/576,787, filed on Dec. 19, 2014, now abandoned.

(51) Int. Cl.
*F04D 29/58* (2006.01)
*F04D 29/42* (2006.01)

(52) U.S. Cl.
CPC ..... *F04D 29/5853* (2013.01); *F04D 29/4206* (2013.01); *F05D 2220/40* (2013.01); *F05D 2240/15* (2013.01); *F05D 2260/231* (2013.01)

(58) Field of Classification Search
CPC ..... F05D 2240/15; F05D 2220/40; F04D 29/5853; F04D 29/4206; F04D 29/4253; F04D 29/4233; F04D 29/624; F05B 2260/31
See application file for complete search history.

(56) References Cited

U.S. PATENT DOCUMENTS

| | | | | |
|---|---|---|---|---|
| 7,014,418 | B1 | 3/2006 | Arnold et al. | |
| 2010/0012920 | A1 | 1/2010 | Park et al. | |
| 2010/0129205 | A1* | 5/2010 | Schwerdel | F02B 37/16 415/148 |
| 2011/0217162 | A1 | 9/2011 | Dillon et al. | |
| 2013/0247565 | A1 | 9/2013 | Marques et al. | |
| 2014/0050576 | A1 | 2/2014 | Li et al. | |

* cited by examiner

*Primary Examiner* — Craig Kim
*Assistant Examiner* — Danielle M Christensen
(74) *Attorney, Agent, or Firm* — BrooksGroup

(57) ABSTRACT

The disclosure describes a compressor housing for a turbocharger system. A scroll section of a collecting volute may be defined by a wall of the compressor housing. The scroll section may extend around the axis of the compressor from an inlet of the volute to a scroll discharge stage. A plate section of the compressor housing may extend from the wall in a radial direction outward from the axis and may extend in a circumferential direction around a substantial portion of the collecting volute. The plate section may be configured to shield heat and may advantageously be formed integral with the compressor housing.

20 Claims, 3 Drawing Sheets

COMPRESSOR COVER WITH INTEGRATED HEAT SHIELD FOR AN ACTUATOR

CROSS-REFERENCE TO RELATED APPLICATIONS

This application is a continuation of U.S. patent application Ser. No. 14/576,787 filed Dec. 19, 2014.

TECHNICAL FIELD

The field to which the disclosure generally relates includes turbochargers for use with internal combustion engines and more particularly, includes turbochargers with an exhaust driven rotary turbine that drives a compressor to charge an engine's air intake system.

BACKGROUND

An exhaust driven turbocharger may typically be used with an internal combustion engine to compress air delivered to the engine's intake air system. The turbocharger may include a compressor wheel that charges the intake system and that is driven by a connected turbine wheel. The compressor may include a housing that collects and channels intake air, and the turbine may include a housing that channels exhaust gases to drive the turbine, which as a result rotates the compressor. The compressor housing may be spaced apart from the turbine housing by a central bearing housing containing bearings that rotatably support the shaft connecting the turbine wheel to the compressor wheel.

The compressor wheel, the shaft and the turbine wheel may rotate at speeds that approach hundreds of thousands of revolutions per minute. In addition, the turbine wheel operates in a high temperature exhaust gas environment, wherein heat may accumulate and be transferred to the other turbocharger system components. Under these harsh, and increasingly demanding operating conditions, the lifespan of a turbocharger is expected to match that of the engine with which it operates. To accomplish that challenge, the design of a turbocharger and its components must be robust to survive as expected, while still being cost effective. As a result, a turbocharger is designed to exacting tolerances and standards. Even small changes in the design or shape of a component can have significant impacts on the performance of a turbocharger system. Accordingly, proven designs provide attractive candidates for reuse in new system applications.

SUMMARY OF ILLUSTRATIVE VARIATIONS

According to a number of illustrative variations, a compressor housing for a turbocharger system may include a scroll section of a collecting volute. The scroll section may be defined by a wall of the compressor housing. The scroll section may extend around the axis of the compressor from an inlet of the volute to a scroll discharge stage. A plate section of the compressor housing may extend from the wall in a radial direction outward from the axis and may extend in a circumferential direction around a substantial portion of the collecting volute. The plate section may be configured to shield heat and may advantageously be formed integral with the compressor housing.

Other illustrative variations within the scope of the invention will become apparent from the detailed description provided herein. It should be understood that the detailed description and specific examples, while disclosing variations within the scope of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

Figure 1:
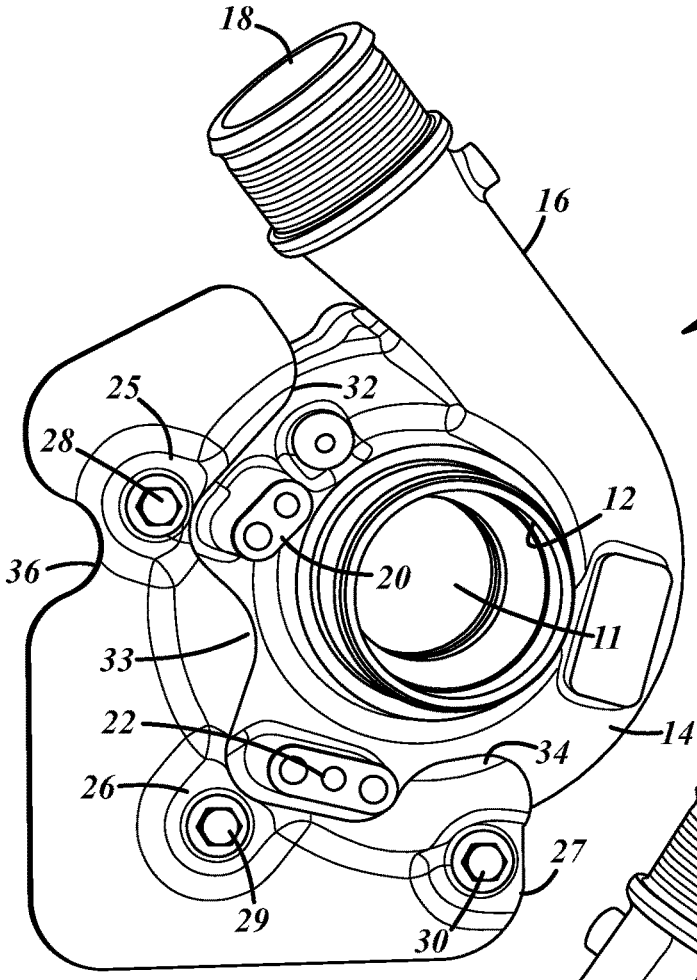
(Prior Art) FIG. 1
FIG. 1 is a perspective view illustrating a prior art compressor housing.

The following description of a prior art compressor housing is intended to provide an understanding of the variations described within the scope of the present invention. Referring to FIG. 1, a prior art compressor housing section 10 includes a central opening 11 that serves as an entry point for incoming air that is induced to flow into a scroll section 14 by an impeller wheel (not shown), that is disposed in the housing section 10. The central opening 11 is surrounded by a flange 12 that will be connected to a duct for channeling air to the compressor housing 10. The spinning impeller wheel generates flow through the scroll section 14, which proceeds on through a scroll discharge stage 16, and out through discharge port 18. When applied to a turbocharging system, the discharge port 18 will be connected to an engine's intake system. The housing section 10 includes a pair of posts 20, 22 for mounting an actuator (not shown) to the housing section 10.

A stamped heat shield 24 is formed with a contoured surface having three drawn lands 25, 26, 27 that include piercings through which bolts 28, 29, 30 are positioned to fasten the heat shield 24 to the housing section 10. The bolts 28, 29, 30 must be torqued no less than, and no more than, a specific range for required retention purposes. The heat shield 24 includes three drawn flanges 32, 33, 34 that are spaced away from the housing section 10 and that curve around part of the scroll section 14 with notches to avoid the posts 20, 22. The flanges 32, 33, 34 extend around the intake side of the scroll section 14, to the extent practical in an effort to shield as much heat as possible from radiating to the intake side of the housing section 10. The outer perimeter of the heat shield 24 includes a notch 36 to provide clearance for an actuator link (not shown).

Figure 2:
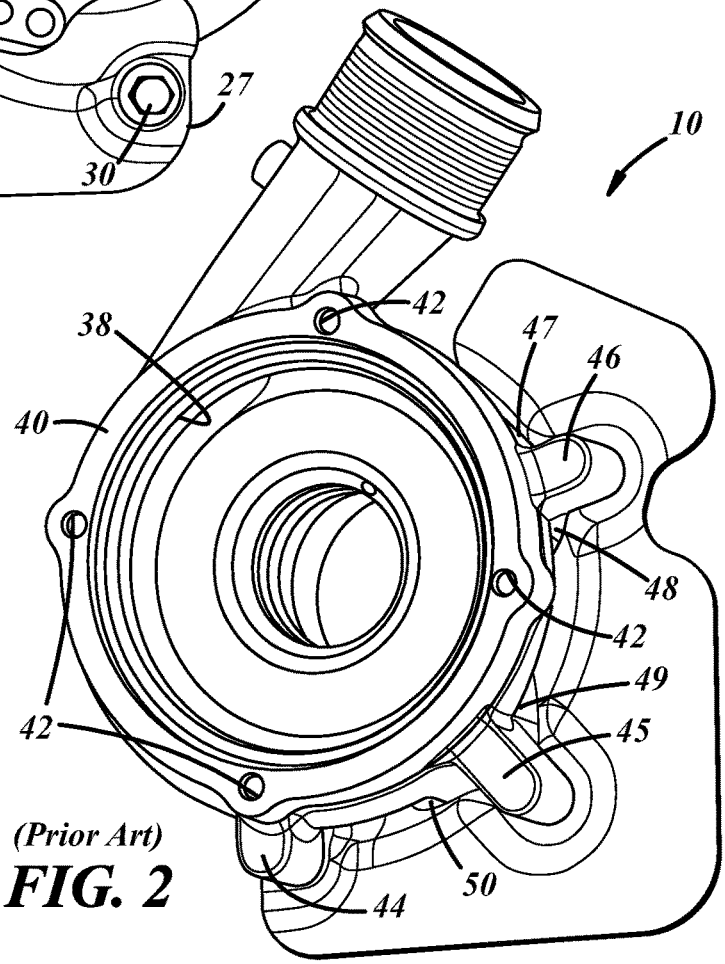
(Prior Art) FIG. 2
FIG. 2 is a perspective view illustrating the prior art compressor housing of FIG. 1 from a turbine side perspective.

Referring to FIG. 2, the turbine side of the housing section 10 is shown with an opening 38 for receiving a compressor wheel (not shown). The housing section 10 includes a flange 40 for connection to a turbocharger system at a central housing (not shown). The flange 40 includes four mounting openings 42 for receiving fasteners. Three bosses 44, 45, 46 extend radially outward from the housing section 10 to provide cantilevered mounting points for the heat shield 24, and which receive the bolts 28, 29, 30. As can be seen the heat shield 24 contacts the housing section 10 only at the bosses 44, 45, 46 for required fastening purposes to minimize heat transfer from the heat shield 24 to the housing section 10, which can reduce efficiency of the compressor. Care must be taken so that the flanges 32, 33, 34 and other parts of the heat shield 24 do not contact the housing section 10. As a result, it can be seen that spaces or gaps 47, 48, 49, 50 exist between the heat shield 24 and the housing section 10. Maintaining spacing between the heat shield 24 and the housing section 10 is important not just to minimize heat transfer but because contact or insufficient spacing may result in undesirable vibratory effects such as noise.

Figure 3:
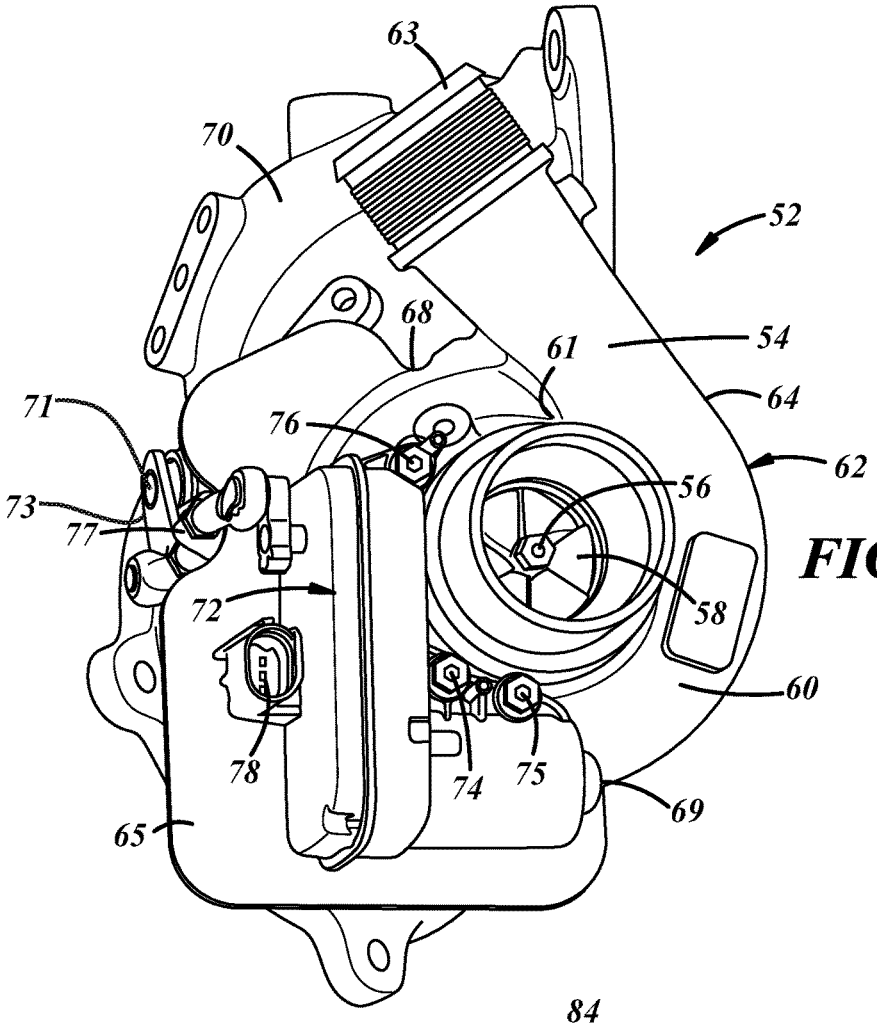
FIG. 3 is an illustration of part of a turbocharger assembly according to a number of variations.

The following description of the variations is merely illustrative in nature and is in no way intended to limit the scope of the invention, its application, or uses. Referring to FIG. 3 a turbocharger assembly 52 according to a number of variations associated with the present invention is illustrated. A compressor housing 54 may be defined around an axis 56 that coincides with a rotational axis of a compressor wheel 58 housed by the compressor housing 54. The compressor housing 54 may include a scroll section 60 of a collecting volute defined by a wall 62 of the compressor housing 54. The scroll section 60 may extend around the axis 56 from an inlet at tongue 61 of the volute to a scroll discharge stage 64. The spinning compressor wheel 58 may generate flow through the scroll section 60, which may proceed on through a scroll discharge stage 64 and out through a discharge port 63.

A plate section 65 may extend from the wall 62 in a radial direction, which is outward from the axis 56. The plate section 65 may extend in a circumferential direction around the axis 56 and around scroll section 60 of the collecting volute from a juncture 68 with the wall 62 near the scroll discharge stage 64, to a juncture 69 with the wall 62. The plate section 65 extends approximately half the way around the circumference of the scroll section 60. The plate section 65 may be configured as a heat shield to interrupt the transmission of heat from the turbine assembly 70 to an actuator assembly 72. The actuator assembly 72 may be mounted to the compressor housing 54 with fasteners 74, 75, 76, and may be connected via a link 77 to an element such as a waste gate or other valve or variable vane device associated with the turbine assembly 70. The link 77 may operate a lever 73 to rotate a shaft 71 that extends into the turbine assembly 70. The actuator assembly 72 may include an electrical connector 78 for connection to an electrical cable for communication with a control system, and may include electronic components and other heat sensitive devices. The plate section 65 may be designed to block heat from the turbine assembly 70, which is driven by heated exhaust gases, with a gap free continuity so that heat may not radiate between the plate section 65 and the compressor housing 54.

Figure 4:
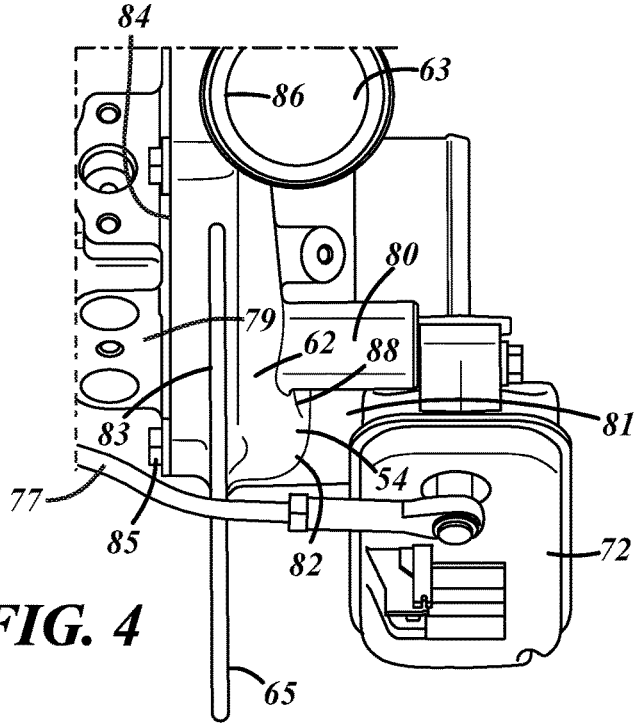
FIG. 4 is a fragmentary illustration of a turbocharger assembly according to a number of variations.

FIG. 4 shows part of the turbocharger assembly 52 from another perspective viewing into the discharge port 63. The compressor housing 54 may be connected to a central housing 79 that may support a shaft that connects the compressor wheel 58 to a turbine wheel in a bearing assembly. The turbine assembly 70 (shown in FIG. 3), may be connected to the opposite side of central housing 78 from compressor housing 54 as shown in FIG. 3. The actuator assembly 72 may be connected to posts 80, 81 of the compressor housing 54. The plate section 65 may be disposed between the turbine assembly 70 and the actuator assembly 72 to block and deflect heat radiating from the turbine assembly 70 so that it does not reach the actuator assembly 72. The plate section 65 may be located at an apex 83 which is the part of the outer circumference of the wall 62 that is most radially distant from the axis 56. This places the plate section 65 radially outward on the wall 62 avoiding an acute angle between the wall 62 and the plate section 65 that might otherwise collect heat. The angle between the wall 62 and the plate section 65 on the turbine assembly 70 side of the compressor housing 54 is minimally 90 degrees or may be an obtuse angle. The apex 83 spirals outward from the axis 56 due to the volute nature of the wall 62, as does the juncture between the wall 62 and the plates section 65.

The heat shielding ability of the plate section 65 is enhanced by a lack of gaps or spaces between the plate section 65 and the compressor housing 54. This is accomplished by forming the housing section 82 and the plate section 65 as one integral piece. The forming method may include casting from aluminum or another appropriate material. As a result, heat is not able to radiate between, and is not channeled between the plate section 65 and the housing section 82. The plate section 65 may be positioned in the axial direction adjacent the mounting flange 84 to which the central housing 79 may be connected by fasteners including fastener 85. In this regard, the plate section 65 may be positioned substantially in line with the turbine side edge 86 of the discharge port 63. This is an advantage of forming the plate section 65 with the housing section 82, since the shield does not need to reach around the curved portion 88 of the wall 62, which expands along the scroll section 60 of the volute.

In addition, rigidity of the housing section 82 may be improved by integrally forming the plate section 65. An important performance criteria of a compressor housing is the ability to perform in harsh demanding environments without resulting in undesirable vibratory effects. In evaluating the structure of a moving system, a modal analysis may be used to determine the natural frequencies. The natural frequencies and mode shapes are important parameters in the design for dynamic loading conditions. A system must be designed to ensure the mechanical resonance frequencies of the component parts do not match driving vibrational frequencies of oscillating parts. The integrated cast-in plate section 65 can improve vibratory performance by stiffening the cast housing and eliminating fasteners. In addition, eliminating the separate heat shield avoids the potential for noise generation. In particular, the plate section 65 does not include spaced apart portions that curve around the curved portion 88 of the wall 62 in an effort to block heat that may otherwise result in undesirable vibratory effects.

Figure 5:
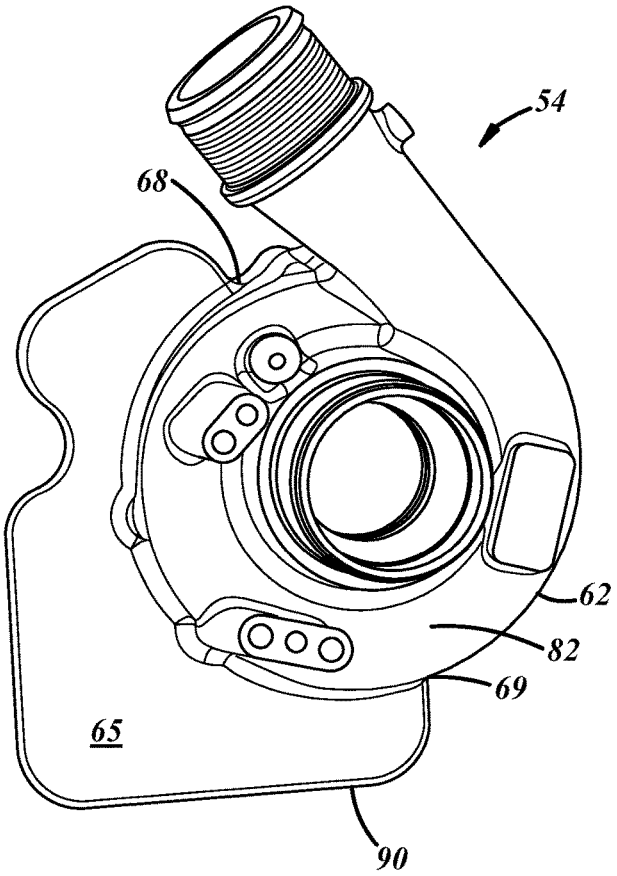
FIG. 5 is a perspective view illustrating a compressor housing according to a number of variations.

Referring to FIG. 5, the continuity of the intersection between the plate section 65 and the housing section 82 is clearly illustrated. The plate section 65 includes an edge 90 around its periphery from the juncture 68 to the juncture 69. The plate section 65 may be defined between the peripheral edge 90 and the wall 62. The plate section 65 may be completely flat for the entirety of the area within the area bounded by the peripheral edge 90 and the wall 62 to deflect heat without concentration points.

Figure 6:
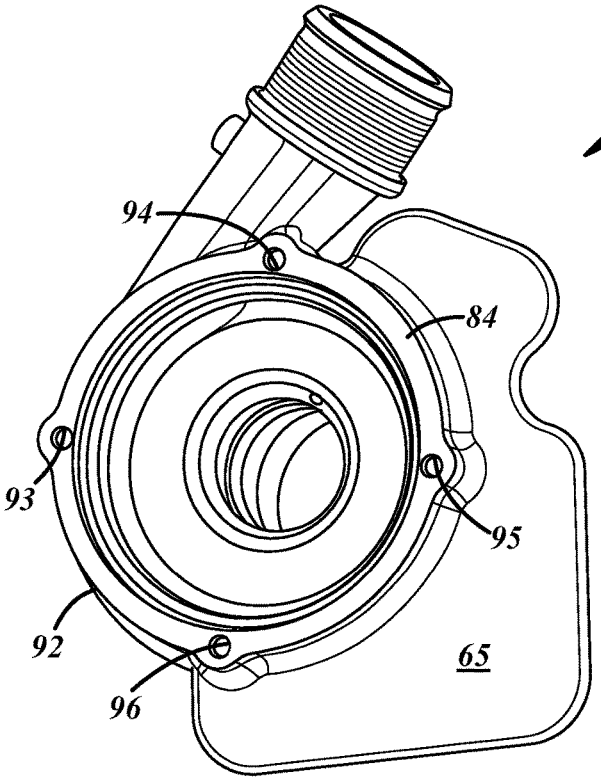
FIG. 6 is a perspective view illustrating a compressor housing of FIG. 5 from a turbine side perspective.

FIG. 6 shows the compressor housing 54 from the turbine side. The plate section 65 is formed adjacent the mounting flange 84 which includes an outer circumference 92 with four equidistantly spaced bosses with mounting holes 93-96 arranged around the outer circumference 92. The plate section 65 is integrally formed with two of the bosses corresponding to mounting holes 95, 96. These two bosses may extend radially outward from the outer circumference 92 and join with the plate section 65 providing increased rigidity.

Through the foregoing structure the potential for missing components during reassembly or improperly torqued parts that may be associated with a heat shield is avoided, and the opportunity for component distortion, deformation, and vibration issues related to thin sheet metal parts is reduced. The following description of variants is only illustrative of components, elements, acts, products and methods considered to be within the scope of the invention and is not in any way intended to limit such scope by what is specifically disclosed or not expressly set forth. Components, elements, acts, products and methods may be combined and rearranged other than as expressly described herein and still are considered to be within the scope of the invention.

Variation 1 may include a compressor housing for a turbocharger system with a scroll section of a collecting volute that is defined by a wall of the compressor housing. The scroll section may extend around the axis of the compressor from an inlet of the volute to a scroll discharge stage. A plate section of the compressor housing may extend from the wall in a radial direction outward from the axis and may extend in a circumferential direction around a substantial portion of the collecting volute. The plate section may be configured to shield heat and may advantageously be formed integral with the compressor housing.

Variation 2 may involve a compressor housing according to variation 1 wherein the compressor housing and the plate section may be cast together as one piece from aluminum.

Variation 3 may involve a compressor housing according to variation 1 or 2 wherein the scroll discharge stage may extend from the scroll section to a discharge port and wherein the plate section may be located in an axial direction in line with an edge of the outlet port on a turbine side of the compressor housing.

Variation 4 may involve a compressor housing according to any of variations 1 through 3 wherein the compressor housing may include an outer circumference with four equidistantly spaced bosses arranged around the outer circumference. The plate section may be integrally formed with at least two of the bosses. The at least two bosses may extend radially outward from the outer circumference and join with the plate section.

Variation 5 may involve a compressor housing according to any of variations 1 through 4 wherein there are no gaps between the wall and the plate section.

Variation 6 may involve a compressor housing according to any of variations 1 through 5 wherein the plate section may include a peripheral edge that extends around the plate between a first juncture with the wall and a second juncture with the wall; and wherein the plate section is entirely flat between the peripheral edge and the wall.

Variation 7 may involve a compressor housing according to any of variations 1 through 6 wherein the compressor housing may include a mounting flange for attaching the compressor housing to the turbocharger system. The plate section may be located in a direction of the axis adjacent the flange.

Variation 8 may include a compressor housing for a turbocharger system and may include a housing section that has a central opening to channel intake air into the housing section. A collecting volute may be formed by the housing section around the central opening. The collecting volute may lead to a discharge stage that may be configured to channel the intake air out of the compressor housing. The collecting volute may include an outer circumference. A heat blocking plate section may extend from the outer circumference in a radially outward direction. The plate section may be formed as one piece with the housing section.

Variation 9 may involve a compressor housing according to variation 8 wherein the outer circumference may have an apex and wherein the plate section may join with the housing section at the apex.

Variation 10 may involve a compressor housing according to variation 8 or 9 wherein the plate section may include a peripheral edge that may extend around the plate section between a first juncture with the wall and a second juncture with the wall. The plate section may exist between the peripheral edge and the wall, wherein the plate section may be entirely flat between the peripheral edge and the wall.

Variation 11 may involve a compressor housing according to any of variations 8 through 10 wherein the plate section may join with the housing section in a gap free continuity.

Variation 12 may include a turbocharger system with a turbine assembly having a lever for operating a shaft. A central housing may be connected to the turbine assembly. A compressor housing may be connected to the central housing. An actuator assembly may be mounted on the compressor housing, and may be linked to the lever to operate the shaft. A plate section may be formed as one piece with the compressor housing and may extend between the actuator assembly and the turbine assembly to block heat from the turbine assembly from reaching the actuator assembly. The plate section may join with the compressor housing in a gap free continuity so that heat from the turbine housing cannot radiate between the plate section and the compressor housing.

The above description of select variations within the scope of the invention is merely illustrative in nature and, thus, variations or variants thereof are not to be regarded as a departure from the spirit and scope of the invention.

What is claimed is:

1. A compressor housing for a turbocharger system, the compressor housing comprising: an axis to coincide with a rotational axis of a compressor wheel housed by the compressor housing, the axis defining an axial direction coincident with the axis, wherein a radial direction is defined as radiating from the axis and normal to the axis; a scroll section of a collecting volute defined by a wall of the compressor housing, the scroll section extending around the axis from an inlet of the volute to a scroll discharge stage; a plate section extending from the wall in a radial direction outward from the axis and extending in a circumferential direction around a portion of the collecting volute, the plate section configured to shield heat; wherein the plate section is integral with the compressor housing; an actuator mounted to the compressor housing; a link connected to the actuator; wherein the plate section extends in the radial direction a distance so as to shield an entire side of the actuator by the plate section.

2. The compressor housing according to claim 1 wherein the compressor housing and the plate section are cast together as one piece from aluminum.

3. The compressor housing according to claim 1 wherein the scroll discharge stage extends from the scroll section to a discharge port, wherein the discharge port has an edge on a turbine side of the compressor housing and wherein the plate section is located in a direction of the axis in line with the edge.

4. The compressor housing according to claim 1 wherein the compressor housing includes an outer circumference with four equidistantly spaced bosses arranged around the outer circumference, wherein the plate section is integrally formed with at least two of the bosses, and wherein the at least two of the bosses extend radially outward from the outer circumference and join with the plate section.

5. The compressor housing according to claim 1 wherein there are no gaps between the wall and the plate section.

6. The compressor housing according to claim 1 wherein the plate section includes a peripheral edge that extends around the plate section between a first juncture with the wall and a second juncture with the wall, and wherein the plate section exists entirely between the peripheral edge and the wall and wherein the plate section is flat between the peripheral edge and the wall.

7. The compressor housing according to claim 1 wherein the compressor housing includes a mounting flange for attaching the compressor housing to the turbocharger system wherein the plate section is located adjacent the mounting flange in a direction of the axis, but the plate section is separate from the mounting flange.

8. A compressor housing for a turbocharger system, the compressor housing comprising: a housing section that has a central opening to channel intake air into the housing section with a collecting volute formed by the housing section around the central opening, the collecting volute leading to a discharge stage configured to channel the intake air out of the compressor housing, with an outer circumference extending around the collecting volute; a mounting flange extending completely around the outer circumference; and a plate section for heat blocking, the plate section extending from the outer circumference in a radially outward direction, the plate section formed as one piece with the housing section, and the plate section extending only partially around the outer circumference from a first juncture with the housing section to a second juncture with the housing section, the first and second junctures spaced apart a distance that is approximately half-way around the outer circumference, to provide the heat blocking.

9. The compressor housing according to claim 8 wherein an axis extends through a center of the central opening, wherein the outer circumference has an apex that is a most distant part of the collecting volute from the axis, and wherein the plate section joins with the housing section at the apex.

10. The compressor housing according to claim 8 wherein the collecting volute is defined by a wall, and wherein the plate section includes a peripheral edge that extends around the plate section between the first juncture and the second juncture and wherein the plate section exists entirely between the peripheral edge and the wall and wherein the plate section is entirely flat between the peripheral edge and the wall.

11. The compressor housing according to claim 8 wherein the plate section joins with the housing section in a gap free continuity.

12. A turbocharger system comprising: a turbine assembly having a lever for operating a shaft, and having a turbine housing; a central housing connected to the turbine assembly; a compressor housing that has a mounting flange that is connected to the central housing; a compressor wheel in the compressor housing that is rotatable about an axis, with an axial direction defined coincident with the axis; an actuator assembly mounted on the compressor housing, the actuator assembly including an actuator linked by a link to the lever to operate the shaft; and a plate section formed as one piece with the compressor housing, the plate section spaced apart from the mounting flange in the axial direction, the plate section extending from the compressor housing away from the axis in a radial direction, the plate section extending between the actuator assembly and the turbine assembly and so that the plate section extends a distance so as to shield an entire side of the actuator to block heat from the turbine assembly from reaching the actuator assembly, and wherein the plate section joins with the compressor housing in a gap free continuity so that heat from the turbine housing cannot radiate between the plate section and the compressor housing, and the link connected between the actuator and the turbine assembly, wherein the link extends in the axial direction across the plate section.

13. The turbocharger system according to claim 12 wherein the plate section includes an open depression in which a peripheral edge dips toward the axis, the link extending through the open depression.

14. The turbocharger system according to claim 12 wherein the plate section includes a turbine side facing the turbine assembly and a compressor side facing away from the turbine assembly, the link disposed closer to the axis on the turbine side than on the compressor side.

15. The turbocharger system according to claim 12 wherein the actuator includes a profile defined by an outline of the actuator at a distance from the axis, wherein the profile, in its entirety, is positioned behind the plate section and the compressor housing from the turbine assembly.

16. The turbocharger system according to claim 12 wherein the mounting flange completely encircles the axis, and the plate section extends only partially around the axis from a first juncture with the compressor housing to a second juncture with the compressor housing, the first and second junctures spaced apart a distance that is approximately half-way around the axis so that the heat from the turbine housing cannot radiate onto the actuator.

17. The turbocharger system according to claim 16 wherein the compressor housing includes a scroll section that begins at a tongue and wherein the first juncture is disposed approximately radially outside the tongue.

18. The turbocharger system according to claim 17 wherein the plate section joins with the compressor housing in the gap free continuity completely from the first juncture to the second juncture.

19. The turbocharger system according to claim 12 wherein the plate section defines an area bounded by a peripheral edge and the compressor housing, and the area is completely flat in its entirety to deflect heat without concentration points.

20. The turbocharger system according to claim 12 comprising posts extending from the compressor housing in the axial direction and away from the turbine assembly, the actuator connected at the posts to locate it away from the plate section, and wherein the actuator is supported on the compressor housing by the posts and not by the plate section.

* * * * *